US005487830A

United States Patent [19]

Huppert

[11] Patent Number: 5,487,830

[45] Date of Patent: Jan. 30, 1996

[54] STATIONARY SKIMMING DEVICE FOR A SWIMMING POOL

[76] Inventor: Daniel B. Huppert, W7641 County Rd. J., Beldenville, Wis. 54003

[21] Appl. No.: 320,277

[22] Filed: Oct. 11, 1994

[51] Int. Cl.[6] ..... B01D 35/02

[52] U.S. Cl. ..... 210/169; 210/242.1; 210/499

[58] Field of Search ..... 210/169, 242.1, 210/499, 459

[56] References Cited

U.S. PATENT DOCUMENTS

| | | | |
|---|---|---|---|
| 3,625,364 | 12/1971 | La Chance | 210/169 |
| 4,068,327 | 1/1978 | Heinlein | 210/169 |
| 4,369,109 | 1/1983 | Edge | 210/169 |
| 4,455,695 | 6/1984 | Mikhel | 210/169 |
| 4,557,001 | 12/1985 | Burkhart | 210/169 |
| 4,836,920 | 6/1989 | Miller, Jr. | 210/169 |
| 4,879,028 | 11/1989 | Gibson | 210/242.1 |
| 5,223,135 | 6/1993 | MacPhee et al. | 210/242.1 |

*Primary Examiner*—Christopher Upton

[57] ABSTRACT

A stationary skimming device for a swimming pool comprising: a plurality of tubular frame pipes formed in a hollow generally cylindrical configuration with two open ends, some of the pipes being positioned vertically and some being positioned horizontally in the operative orientation, each of the pipes including coupling means at their respective ends to permit attachment to an adjacent pipe, the pipes forming a generally rectangular configuration in the fully assembled orientation, the pipes having coupling devices affixed along their length, a screen being positioned between the pipes, the edges of the screens being coupled within the coupling devices along the length of the pipes, at least one of the pipes having a horizontally positioned hook extending perpendicularly therefrom, the hook including adjustable coupling means and adapted to be affixed to the edge of a swimming pool in the operative orientation.

1 Claim, 4 Drawing Sheets

STATIONARY SKIMMING DEVICE FOR A SWIMMING POOL

BACKGROUND OF THE INVENTION

1. Field of the Invention

The present invention relates to a stationary skimming device for a swimming pool and more particularly pertains to removing floating debris from swimming pools by directing water circulation through the stationary screens of the apparatus.

2. Description of the Prior Art

The use of swimming pool cleaning devices is known in the prior art. More specifically, swimming pool cleaning devices heretofore devised and utilized for the purpose of cleaning and purifying swimming pool water are known to consist basically of familiar, expected, and obvious structural configurations, notwithstanding the myriad of designs encompassed by the crowded prior art which has been developed for the fulfillment of countless objectives and requirements.

By way of example, the prior art discloses in U.S. Pat. No. 5,084,175 to Hoffmeier a pool filter.

U.S. Pat. No. 5,128,031 to Midkiff discloses a pool surface skimmer.

U.S. Pat. No. 5,234,588 to Aymes device discloses a device for cleaning swimming pool.

U.S. Pat. No. 4,578,186 to Morin discloses a swimming pool system.

Lastly, U.S. Pat. No. 3,550,779 to Cattano discloses a swimming pool filter.

In this respect, the stationary skimming device for a swimming pool according to the present invention substantially departs from the conventional concepts and designs of the prior art, and in doing so provides an apparatus primarily developed for the purpose of removing floating debris from swimming pools by directing water circulation through the stationary screens of the apparatus.

Therefore, it can be appreciated that there exists a continuing need for a new and improved stationary skimming device for a swimming pool which can be used for removing floating debris from swimming pools by directing water circulation through the stationary screens of the apparatus. In this regard, the present invention substantially fulfills this need.

SUMMARY OF THE INVENTION

In view of the foregoing disadvantages inherent in the known types of swimming pool cleaning devices now present in the prior art, the present invention provides an improved stationary skimming device for a swimming pool. As such, the general purpose of the present invention, which will be described subsequently in greater detail, is to provide a new and improved stationary skimming device for a swimming pool and method which has all the advantages of the prior art and none of the disadvantages.

To attain this, the present invention essentially comprises a new and improved stationary skimming device for a swimming pool comprising, in combination: seven tubular frame pipes and one tubular side pipe, each pipe being fabricated of plastic and formed in a hollow generally cylindrical configuration with two open ends, the open end of each pipe including coupling means affixed therearound, each pipe including a plurality of radially positioned apertures and adjustable coupling devices affixed along its length, the apparatus including three vertically positioned pipes having an upper end and a lower end, the pipes being positioned in horizontal alignment from the edge of a swimming pool outward, the apparatus including two upper horizontal pipes being positioned between the upper ends; of the vertically positioned pipes, the apparatus including two lower horizontal pipes being positioned between the lower ends of the vertically positioned pipes, the lower horizontal pipes including a generally L-shaped shelf formed contiguously with the adjustable coupling devices and extending approximately radially therefrom, the apparatus including two upper horizontal pipes being positioned between the upper ends of the vertically positioned pipes, the apparatus including a single tubular side pipe having an inboard end and an outboard end, the inboard end being positioned adjacent to the inboard end of the innermost horizontal pipe, the outboard end of the tubular side pipe being positioned adjacent to the upper end of the central vertical pipe, the apparatus adapted to be partially submerged in a swimming pool in the operative orientation; seven tubular connectors being fabricated of plastic and formed in a hollow generally cylindrical configuration with two or more open ends, three elbow connectors being formed in a curved L-shaped configuration with coupling means affixed within their open ends, two three-way connectors being formed in a hollow generally cylindrical configuration with two linearly positioned open ends and a third open end positioned therebetween, a four-way connector being formed in a hollow generally cylindrical configuration with four open ends, a two-way connector being formed in a hollow generally cylindrical linear configuration with two open ends, the connectors coupling two or more pipes therein and permitting easy assembly and disassembly of the apparatus; two screens being formed in a generally rectangular configuration, each screen being comprised of a plurality of vertical and horizontally positioned synthetic fibers, the fibers forming a grid configuration with a plurality of generally rectangular shaped holes extending therethrough, the edges of each screen being positioned within the coupling means along the length of each horizontal and vertical pipe, each screen extending between the horizontal and vertical pipes with the middle vertical pipe separating the two screens therebetween, the screens adapted to catch floating debris as water circulates through the screens; two adjustable hooks each having an inboard region, an outboard region, and a central region therebetween, the inboard region having a generally cylindrical shaped sleeve extending therefrom, the sleeve having an aperture extending vertically therethrough, a hollow cylindrically shaped adjustment tube with a plurality of vertically positioned apertures extending therethrough being positioned within the sleeve, a lock pin formed in a solid generally L-shaped configuration being positioned through the sleeve and adjustment tube with the desired apertures in vertical alignment, the outboard end of the adjustable hook having a generally L-shaped configuration, one end adapted to be positioned in the central region with the other end adapted to be positioned under the ledge of a swimming pool, the central region being formed as a hollow cylindrically shaped member contoured into an L-shaped configuration, the central region coupling the inboard and outboard regions, one adjustment hook being coupled to a three-way connector at the inboard end of the vertical pipe, the second adjustment hook being coupled to the free end of the tubular side pipe, the second hook and side pipe adapted to help stabilize the apparatus as water flows through the screens.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent of legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved stationary skimming device for a swimming pool which has all of the advantages of the prior art swimming pool cleaning devices and none of the disadvantages.

It is another object of the present invention to provide a new and improved stationary skimming device for a swimming pool which may be easily and efficiently manufactured and marketed.

It is further object of the present invention to provide a new and improved stationary skimming device for a swimming pool which is of durable and reliable constructions.

An even further object of the present invention is to provide a new and improved stationary skimming device for a swimming pool which is susceptible of a low cost of manufacture with regard to both materials and labor, and which accordingly is then susceptible of low prices of sale to the consuming public, thereby making such stationary skimming device for a swimming pool economically available to the buying public.

Still yet another object of the present invention is to provide a new and improved stationary skimming device for a swimming pool which provides in the apparatuses and methods of the prior art some of the advantages thereof, while simultaneously overcoming some of the disadvantages normally associated therewith.

Still another object of the present invention is to remove floating debris from swimming pools by directing water circulation through the stationary screens of the apparatus.

Lastly, it is an object of the present invention to provide a new and improved stationary skimming device for a swimming pool comprising: a plurality of tubular frame pipes formed in a hollow generally cylindrical configuration with two open ends, some of the pipes being positioned vertically and some being positioned horizontally in the operative orientation, each of the pipes including coupling means at their respective ends to permit attachment to an adjacent pipe, the pipes forming a generally rectangular configuration in the fully assembled orientation, the pipes having coupling devices affixed along their length, a screen being positioned between the pipes, the edges of the screens being coupled within the coupling devices along the length of the pipes, at least one of the pipes having a horizontally positioned hook extending perpendicularly therefrom, the hook including adjustable coupling means and adapted to be affixed to the edge of a swimming pool in the operative orientation.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various Figures.

DESCRIPTION OF THE PREFERRED EMBODIMENT

Figure 1:
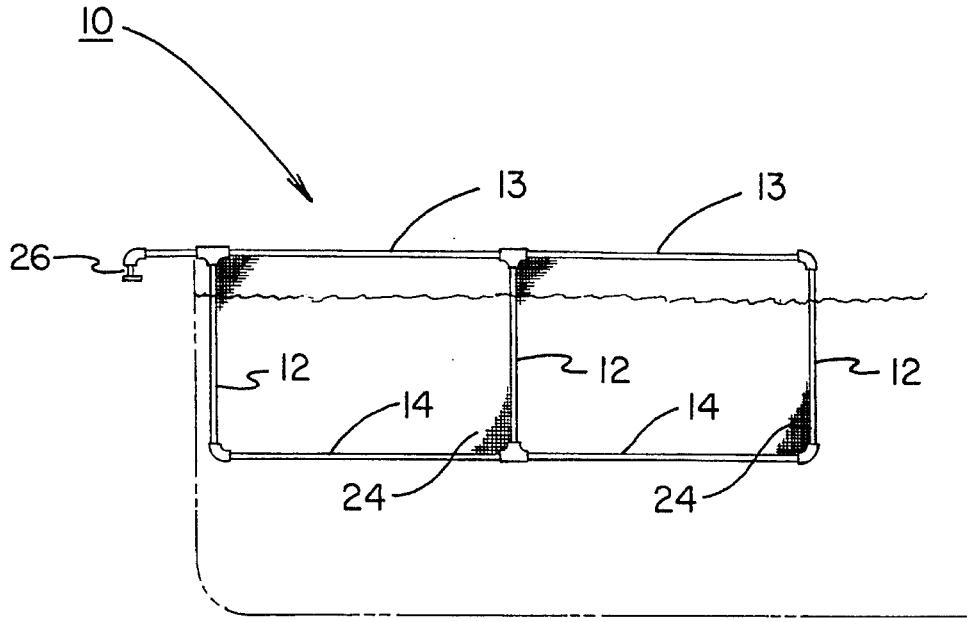
FIG. 1 is a perspective view of the preferred embodiment of the stationary skimming device for a swimming pool constructed in accordance with the principles of the present invention.

With reference now to the drawings, and in particular to FIG. 1 thereof, the preferred embodiment of the new and improved stationary skimming device for a swimming pool embodying the principles and concepts of the present invention and generally designated by the reference numeral 10 will be described.

The present invention, the stationary skimming device for a swimming pool 10 is comprised of a plurality of components. Such components in their broadest context include tubular frame pipes 12, 13, 14, a tubular side pipe 16, tubular connectors 18, 20, 22, 23, two screens 24 and two adjustable hooks 26. Such components are individually configured and correlated with respect to each other so as to attain the desired objective.

Figure 7:
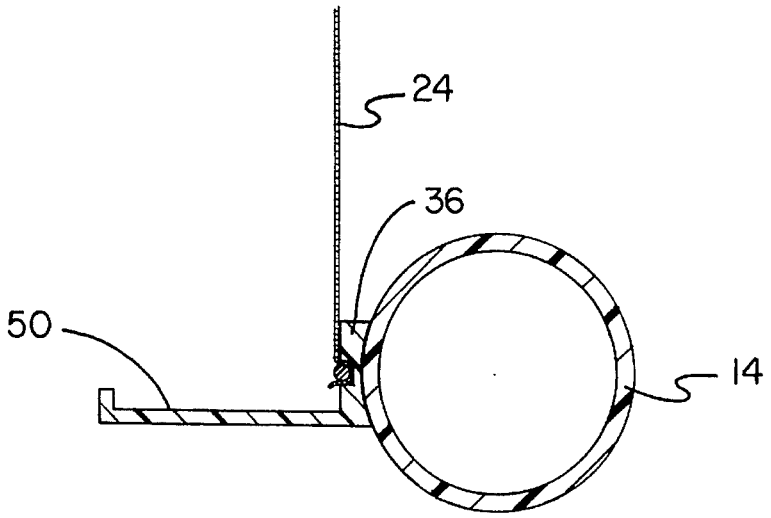
FIG. 7 is a cross sectional view of a tubular frame pipe of the apparatus illustrating the adjustable coupling means affixed thereto, the coupling means being adapted to secure the screens in a taught orientation between the frame pipes.
Figure 8:
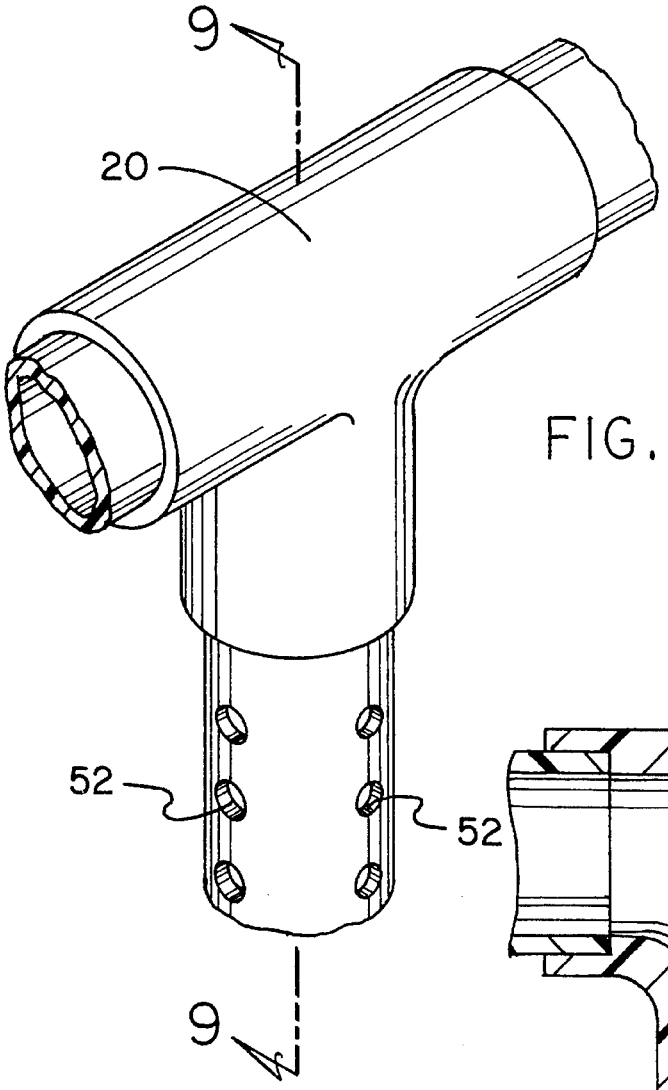
FIG. 8 is a partially broken away perspective view of the three-way connector component of the apparatus.
Figure 9:
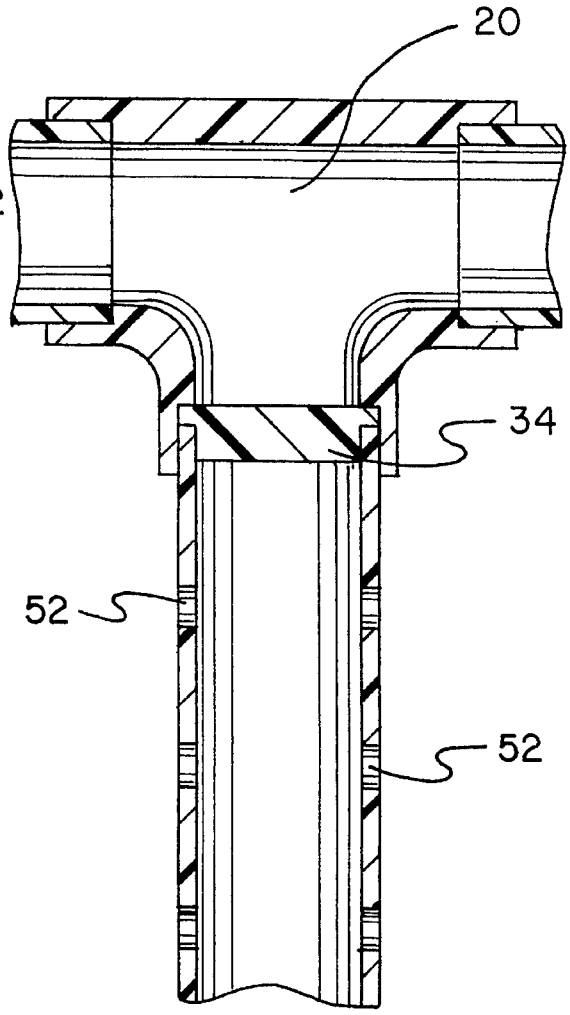
FIG. 9 is a cross sectional view of the three-way connector taken along line 9—9 of FIG. 8.

More specifically, seven tubular frame pipes 12, 14 and one tubular side pipe 16 are each fabricated of plastic and formed in a hollow generally cylindrical configuration with two open ends. The open end of each pipe includes coupling means 34 affixed therearound. The pipe ends are adapted to fit securely within tubular couplers in the operative orientation. The releasably coupled components of the apparatus permit easy assembly and disassembly by the user. Note FIG. 8. Additionally, each pipe includes adjustable coupling devices 36 affixed along its length. Each pipe also includes a plurality of radially positioned apertures 52 extending therethrough. The apertures allow water to fill the interior of the pipes to permit the receipt of water when submerged in a swimming pool. The submerged pipes help stabilize the apparatus. The coupling devices are adapted to secure the edges of the screens therein. The coupling devices are configured to permit tightening of the screens. Note FIG. 7.

Figure 2:
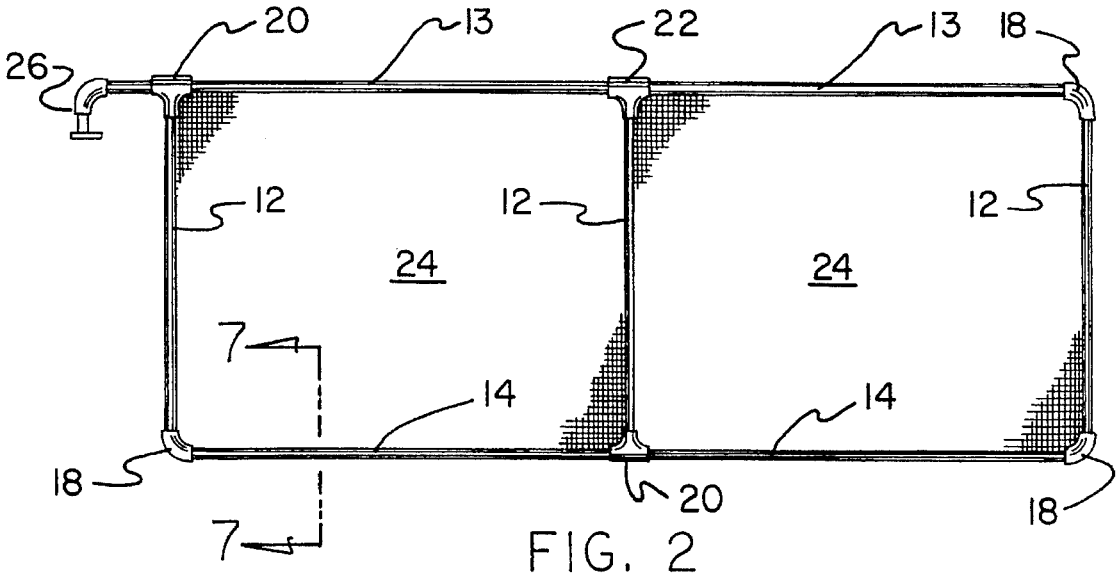
FIG. 2 is a perspective view of the apparatus shown in FIG. 1 as removed from a swimming pool.

The apparatus includes three vertically positioned pipes 12. Each pipe has an upper end and a lower end. One of the pipes is positioned inboardly with respect to the edge of a pool. One pipe is positioned outboardly with respect to the edge of a pool. The outboard pipe is positioned near the center of the pool. A central vertical pipe is positioned between the inboard and outboard vertical pipes. The apparatus includes two upper horizontal pipes 13. Each upper horizontal pipe 13 is positioned between the upper ends of the vertically positioned pipes. The ends of the inboard upper horizontal pipe are coupled to the inboard and central vertical pipes with three-way connectors. The outboard end of the outboard upper horizontal pipe is coupled to the outboard vertical pipe with an elbow connector. Note FIGS. 1 and 2.

The apparatus includes two lower horizontal pipes 14. Each lower horizontal pipe is positioned between the lower ends of the vertically positioned pipes. The horizontal pipes include a generally L-shaped shelf 50 which is formed contiguously with the adjustable coupling devices. Each shelf extends approximately radially from the coupling devices. Each shelf prevents captured debris from falling back into the pool when the user removes the apparatus for cleaning. Each of the lower horizontal pipes is coupled to the central vertical pipe with a three-way connector. The opposite end of each lower horizontal pipe is coupled to the adjacent vertical pipe with an elbow connector. Note FIGS. 1 and 2.

Figure 3:
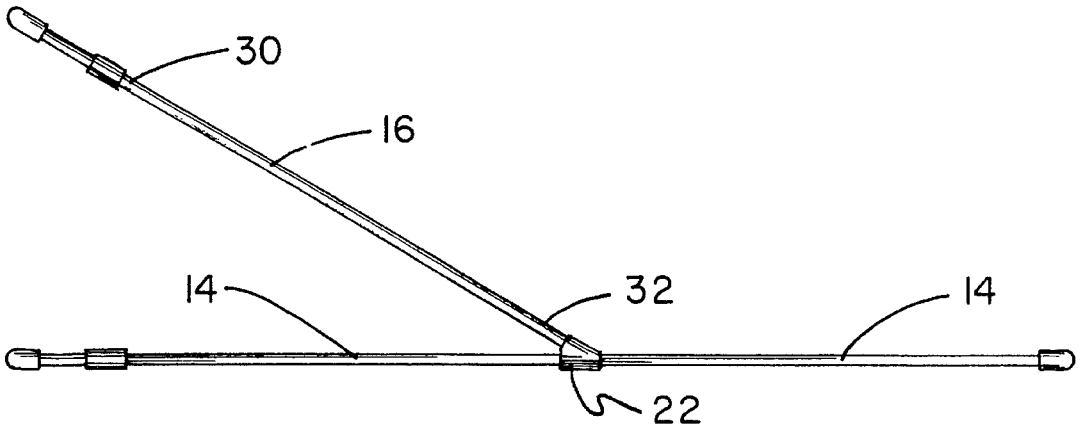
FIG. 3 is a top plan view of the apparatus illustrating the orientation of the tubular side pipe.

A single tubular side pipe has an inboard end 30 and an outboard end 32. The inboard end is positioned even with, and a short distance from the inboard end of the inner upper horizontal pipe. The outboard end of the tubular side pipe is positioned adjacent to the upper end of the central vertical pipe. The side pipe is coupled to the apparatus by way of a four-way connector. The tubular side pipe provides the apparatus with additional strength and stability. The side pipe is positioned upstream with respect to the flow of water to prevent bending of the device. Note FIG. 3.

Eight tubular connectors 18, 20, 22, 23 are fabricated of plastic and formed in a hollow generally cylindrical configuration with two or more open ends. Three elbow connectors 18 are formed in a curved L-shaped configuration with coupling means 34 affixed within their open ends. Two elbow connectors are positioned at the upper and lower ends of the outboard vertical tube. These tubes couple the upper and lower outboard horizontal tubes thereto. A third elbow connector is positioned at the lower end of the inboard vertical tube. Note FIGS. 1 and 2.

Two three-way connectors 20 are formed in a hollow generally cylindrical configuration with two linearly positioned open ends and a third open end which is positioned therebetween. A first three-way connector is positioned on the lower end of the central vertical connector. The inboard and outboard lower horizontal tubes are coupled therebetween. A second three-way connector is positioned on the upper end of the inboard vertical pipe. The inboard upper horizontal pipe is coupled therein. A four-way connector 22 is formed in a hollow generally cylindrical configuration with four open ends. The four-way connector couples together the two upper horizontal pipes, the upper end of the central vertical pipe, and the tubular side pipe. Note FIG. 3. The connectors permit easy assembly and disassembly of the apparatus. Note FIGS. 1, 2 and 3.

Two screens 24 are formed in a generally rectangular configuration. Each screen is comprised of a plurality of vertical and horizontally positioned synthetic fibers. The synthetic fibers form a grid configuration. A plurality of generally rectangular shaped holes is formed between the fibers. The edges of each screen are positioned within the coupling means 36 along the length of each horizontal and vertical pipe. Each screen extends between the horizontal and vertical pipes with a middle vertical pipe separating the screens therebetween. The coupling devices are adapted to permit the user to tighten the screens when deemed necessary. Note FIGS. 1 and 2.

The screens are adapted to catch debris floating on or under the surface of swimming pools as water circulates through. Bugs, leaves, and other debris get caught in the screen both above and below the surface of the water. To clean the apparatus the user simply removes the device from the pool. The screens may then be easily cleaned with a standard garden hose. The simplicity and efficiency of the apparatus permits users to cleanse their pools of most floating debris with a minimal effort. The apparatus is also effects cleaning in a very short period of time. Note FIG. 1.

Figure 6:
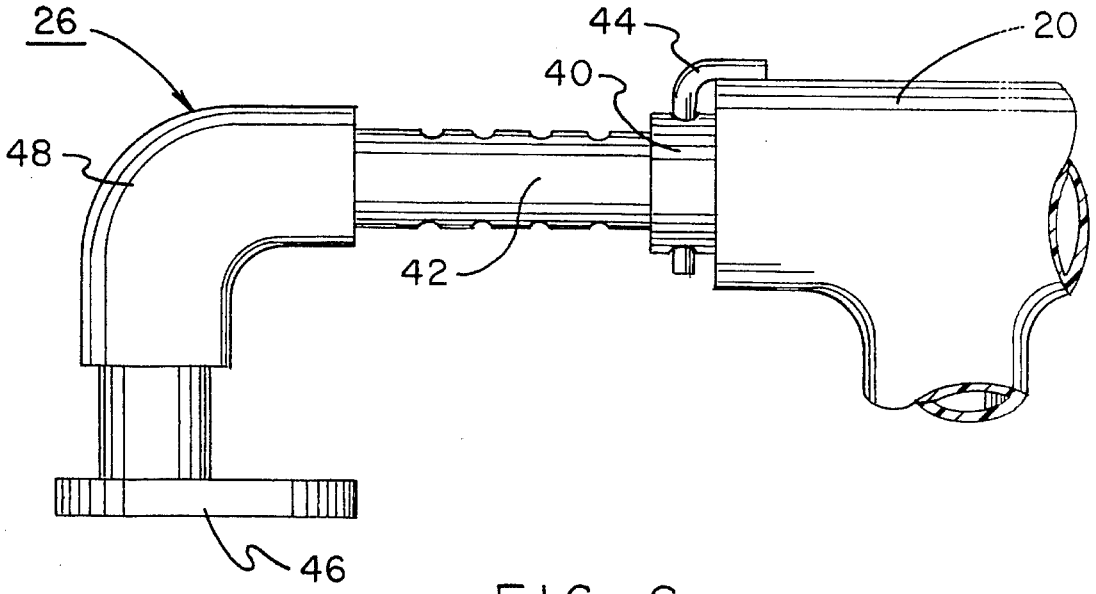
FIG. 6 is an exploded broken away perspective view of the adjustable hook component of the apparatus along with its cooperatively coupled lock pin.

Two adjustable hooks 26 each have an inboard region, an outboard region, and a central region therebetween. The inboard region 40 has a generally cylindrical shaped sleeve extending therefrom. The sleeve has an aperture which extends vertically through two diametrically opposing sides of the sleeve. A hollow adjustment tube 42 is formed in a generally cylindrical configuration and is positioned within the sleeve. Each adjustment tube has a plurality of vertically positioned apertures extending therethrough. A lock pin is formed in a solid generally L-shaped configuration. The lock pin 44 is adapted to be positioned through the sleeve and adjustment tube with the desired apertures positioned in vertical alignment. The adjustment tube can be moved to a variety of different lengths to accommodate the varying ledge widths of many different kinds of pools. Note FIG. 6.

The outboard end 46 of the adjustable hook has a generally L-shaped configuration. One end is adapted to be positioned in the central region 48, and one end is adapted to be positioned under the ledge of a swimming pool in the operative orientation. The central region is formed as a hollow generally cylindrical shaped member and contoured in an L-shaped configuration. The central region securely couples the inboard and outboard regions together. One adjustment hook is coupled with the three way connector at the inboard end of the vertical pipe. The second adjustment hook is coupled to the free end of the tubular side pipe with a linear two way connector. The tubular side pipe and cooperatively coupled second hook are adapted to help stabilize the apparatus as water flows through the screen. Note FIGS. 1 and 3.

Figure 4:
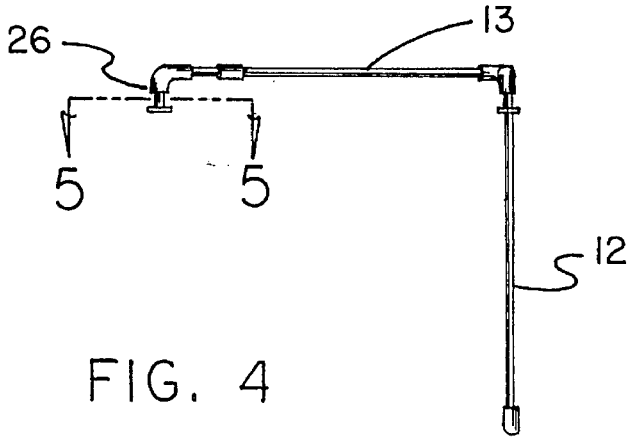
FIG. 4 is a partial broken away perspective view of the apparatus illustrating the frame pipes and the adjustable hook coupled thereto.
Figure 5:
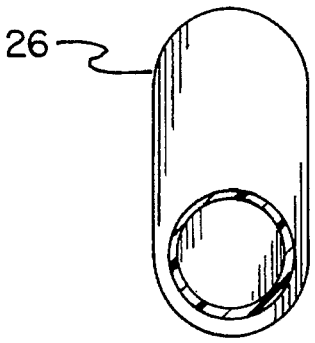
FIG. 5 is cross sectional view of the adjustable hook component taken along line 5—5 of FIG. 4.

The adjustment hook is adapted to permit a user to affix the apparatus to the edges of differently sized swimming pool edges in the operative orientation. To adjust the length of the adjustment hook, the user simply slides the adjustment tube further within the sleeve and aligns the desired apertures with those in the sleeve. The lock pin is then vertically positioned through the aligned apertures. The hooks securely affix the frame pipes and side pipe to the edge of a pool in the operative orientation. Note FIGS. 4, 5 and 6.

Relaxing in the comfort of a private pool is one of the most enjoyable of recreational activities. Inviting friends for pool parties and barbecues, or simply winding down after a hard day at work can make ownership and maintenance of a pool well worthwhile. In addition to the tasks of testing the water quality, cleaning the filter, and making a pool clean and safe, there is also the need to physically remove floating debris from the water. Conventional pool filters are effective only for the volume of water which is drawn into their inlets. Matter that remains must be extracted using a skimmer net, vacuum, or other suitable tool. But the task of skimming is very time consuming when done by hand, and must be performed at regular intervals. That is why the stationary skimming device for a swimming pool was conceived. The apparatus provides an autonomous method of skimming which can be operated unattended. It requires no electrical power and has no moving parts.

The stationary skimming device for a swimming pool is constructed from a rigid frame surrounding a synthetic screen material. The frame is made from weather resistant plastic and is assembled in a rectangular shape. There is a central vertical pipe at the center, and a side pipe attached at an angle to the upper horizontal pipes. There are also two adjustable hooks at each end of the frame where it is attached to the pool. The screen is installed between the frame segments and serves to remove the floating debris from the pool water.

To use the stationary skimming device for a swimming pool, the user simply hangs it over the side of a pool so that it extends straight outward toward the center. Most of the screen becomes submerged below the surface of the water to trap the debris. As the water slowly circulates around the pool, the debris is trapped by the screen. The apparatus can then be removed and hosed clean. Nothing could be easier.

The apparatus operates without power because the force of the treated water which exits from the filter exhaust is sufficient to provide the circular movement of the water. When floating bugs and debris swirl to within reach of the screen, they are collected from the surface. Depending on the severity of the contamination, the apparatus should be capable of cleaning the entire pool surface in just minutes. The stationary skimming device for a swimming pool is easy to install, maintenance free, and is almost certain to be appreciated by pool lovers nationwide.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new and improved stationary skimming device for a swimming pool comprising, in combination:

seven tubular frame pipes and one tubular side pipe, each pipe being fabricated of plastic and formed in a hollow generally cylindrical configuration with two open ends, the open end of each pipe including adjustable coupling means affixed therearound, each pipe including a plurality of radially positioned apertures and adjustable coupling devices affixed along its length, the apparatus including three vertically positioned pipes having an upper end and a lower end, the pipes being positioned in horizontal alignment from the edge of a swimming pool outward, the apparatus including two upper horizontal pipes being positioned between the upper ends of the vertically positioned pipes, the apparatus including two lower horizontal pipes being positioned between the lower ends of the vertically positioned pipes, the lower horizontal pipes including a generally L-shaped shelf formed contiguously with the adjustable coupling devices and extending approximately radially therefrom, the apparatus further including a single tubular side pipe having an inboard end and an outboard end, the inboard end being positioned adjacent to the inboard end of the innermost horizontal pipe, the outboard end of the tubular side pipe being positioned adjacent to the upper end of the central vertical pipe, the apparatus being partially submerged in a swimming pool in the operative orientation;

seven tubular connectors being fabricated of plastic and formed in a hollow generally cylindrical configuration with two or more open ends, three elbow connectors being formed in a curved L-shaped configuration with coupling means affixed within their open ends, two three-way connectors being formed in a hollow generally cylindrical configuration with two linearly positioned open ends and a third open end positioned therebetween, a four-way connector being formed in a hollow generally cylindrical configuration with four open ends, a two-way connector being formed in a hollow generally cylindrical linear configuration with two open ends, the connectors coupling two or more pipes therein and permitting easy assembly and disassembly of the apparatus;

two screens being formed in a generally rectangular configuration, each screen being comprised of a plurality of vertical and horizontally positioned synthetic fibers, the fibers forming a grid configuration with a plurality of generally rectangular shaped holes extending therethrough, the edges of each screen being positioned within the adjustable coupling means along the length of each horizontal and vertical pipe, each screen extending between the horizontal and vertical pipes with the middle vertical pipe separating the two screens therebetween; and two adjustable hooks each having an inboard region, an outboard region, and a central region therebetween, the inboard region having a generally cylindrical shaped sleeve extending therefrom, the sleeve having an aperture extending vertically therethrough, a hollow cylindrically shaped adjustment tube with a plurality of vertically positioned apertures extending therethrough being positioned within the sleeve, a lock pin formed in a solid generally L-shaped configuration being positioned through the sleeve and adjustment tube with the desired apertures in vertical alignment, the outboard end of the adjustable hook having a generally L-shaped configuration, one end positioned in the central region with the other end positioned under the ledge of a swimming pool, the central region being formed as a hollow cylindrically shaped member contoured into an L-shaped configuration, the central region coupling the inboard and outboard regions, one adjustment hook being coupled to a three-way connector at the inboard end of the vertical pipe, the second adjustment hook being coupled to the free end of the tubular side pipe, the second hook and side pipe constructed to help stabilize the apparatus as water flows through the screens.

* * * * *